US006127640A

United States Patent [19]

Pan et al.

[11] Patent Number: 6,127,640

[45] Date of Patent: Oct. 3, 2000

[54] KEYSWITCH ASSEMBLY

[75] Inventors: Hua-Tseng Pan; Yu-Jie Li, both of Taipei, Taiwan

[73] Assignee: Hon Hai Precision Ind. Co., Ltd., Taipei Hsien, Taiwan

[21] Appl. No.: 09/219,176

[22] Filed: Dec. 22, 1998

[30] Foreign Application Priority Data

Jul. 23, 1998 [TW] Taiwan ..... 87211922

[51] Int. Cl.[7] ..... H01H 3/12

[52] U.S. Cl. ..... 200/344

[58] Field of Search ..... 200/344, 5 A, 200/517

[56] References Cited

U.S. PATENT DOCUMENTS 5,256,843 10/1993 Chiba et al. ..... 200/517
5,625,532 4/1997 Sellers ..... 200/344 X
5,964,341 10/1999 Tsai ..... 200/344

*Primary Examiner*—Renee Luebke

[57] ABSTRACT

A keyswitch assembly for constructing a computer keyboard consists of a cap for receiving a key-in force from a user, a link, a conductive rubber, a circuit membrane, a mounting block and a base plate. The base plate defines a number of recesses in one of which the mounting block is fittingly received. The mounting block is formed by plastic injection molding to integrally have mounting brackets and L-shaped protrusion which project through the circuit membrane to supportively engage with a lower portion of the link. An upper portion of the link engages with the cap. The conductive rubber is located on a corresponding switch of a circuit on the circuit membrane and has an upper portion extended through the link to engage with the cap. In an alternative embodiment, screws are used to fixedly connect the mounting block and the base plate together. In a further alternative embodiment, a heat melting operation is applied to a free end of a shaft of the mounting block extending through the base plate to fixedly connect the mounting block and the base plate together.

6 Claims, 8 Drawing Sheets

KEYSWITCH ASSEMBLY

BACKGROUND OF THE INVENTION

1. Field of the Invention

The present invention relates to a keyswitch assembly, and particularly to a keyswitch assembly for constructing a computer keyboard.

2. The Prior Art

Referring to FIG. 1, a prior art keyswitch assembly 10 for constructing a computer keyboard is shown. The keyswitch assembly 10 consists of a plastic cap 12 adapted to receive an external force from a user of the computer, a plastic scissors-like link 14, a metallic mounting plate 16, a conductive rubber 18, a plastic base plate 22, and a circuit membrane 20 attached to the base plate 22. The circuit membrane 20 has an electrical circuit 21 thereon. The mounting plate 16 is formed by stamping with a number of mounting units 23 (only one shown) each consisting of two pairs of brackets 24 for supportively engaging with two feet 142 of the corresponding link 14. The mounting plate 16 further defines a number of holes 25 (only one shown) each being within a corresponding one of the mounting units 23 for extension of an upper portion of the corresponding conductive rubber 18 therethrough to drivably engage with the cap 12. The link 14 has four upper studs 144 supportively engage with the cap 12. When the cap 12 is depressed, the rubber 18 is pressed to cause a corresponding switch on the circuit 21 to close, whereby a signal representing the corresponding key is input into the computer.

Such prior art key assembly 10 has a disadvantage that once a bracket 24 of the mounting plate 16 is improperly formed or damaged whereby it cannot correctly engage with the link 14, the mounting plate 16 should be entirely discarded, which is very unfavorable in view of the cost. Unfortunately, since a computer keyboard has more than one hundred keys, which result in the necessity of more than four hundred brackets formed on the mounting plate 16, the possibility that one of the brackets 24 is improperly formed or damaged is relatively high.

Furthermore, a die for stamping so many brackets on a single metal plate is expensive.

Hence, an improved keyswitch assembly for constructing a computer keyboard is needed to eliminate the above mentioned defects of the current art.

SUMMARY OF THE INVENTION

Accordingly, an objective of the present invention is to provide a keyswitch assembly for constructing a computer keyboard which has a lower cost in comparison with the conventional one.

To fulfill the above mentioned objective, according to one embodiment of the present invention, a keyswitch assembly includes a cap, a link and a conductive rubber all of which have a structure similar to the conventional ones, a circuit membrane with an electrical circuit thereon, a mounting block formed by plastic injection molding with mounting means thereon which extends through the membrane to supportively engage with feet of the link. The link has upper studs connecting with the cap. A base plate is formed by plastic injection molding to define a number of recesses therein one of which fittingly receives a corresponding mounting block. The conductive rubber is located on a corresponding switch of the circuit on the circuit membrane and has an upper portion extending through the link to drivably engage with the cap. When the cap is depressed, the conductive rubber causes the switch to close whereby a signal representing the key is input into the computer.

DETAILED DESCRIPTION OF THE PREFERRED EMBODIMENT

Reference will now be made in detail to the preferred embodiments of the present invention.

Figure 1:
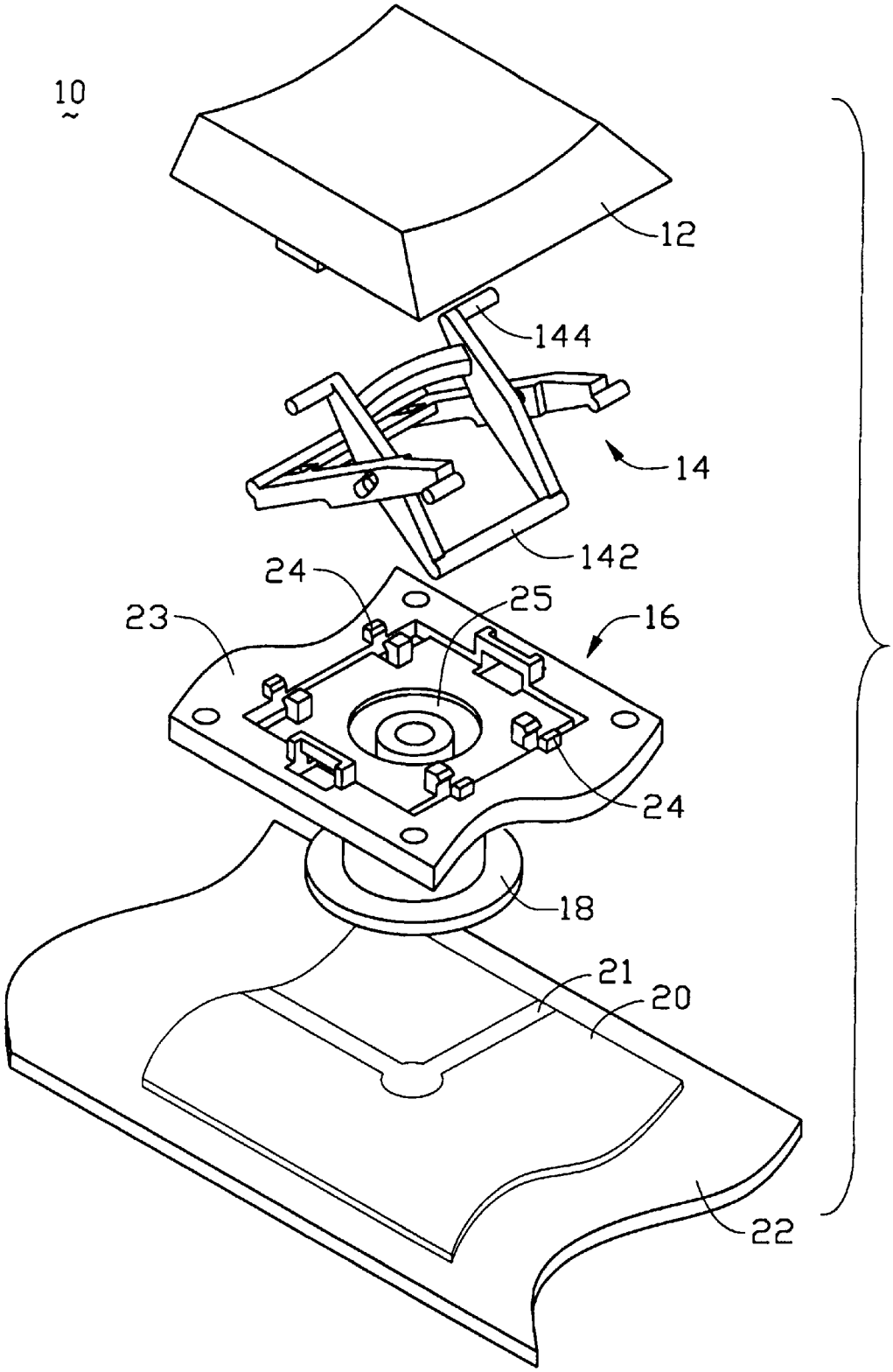
FIG. 1 (PRIOR ART)
FIG. 1 is an exploded view of a keyswitch assembly in accordance with prior art.
Figure 2:
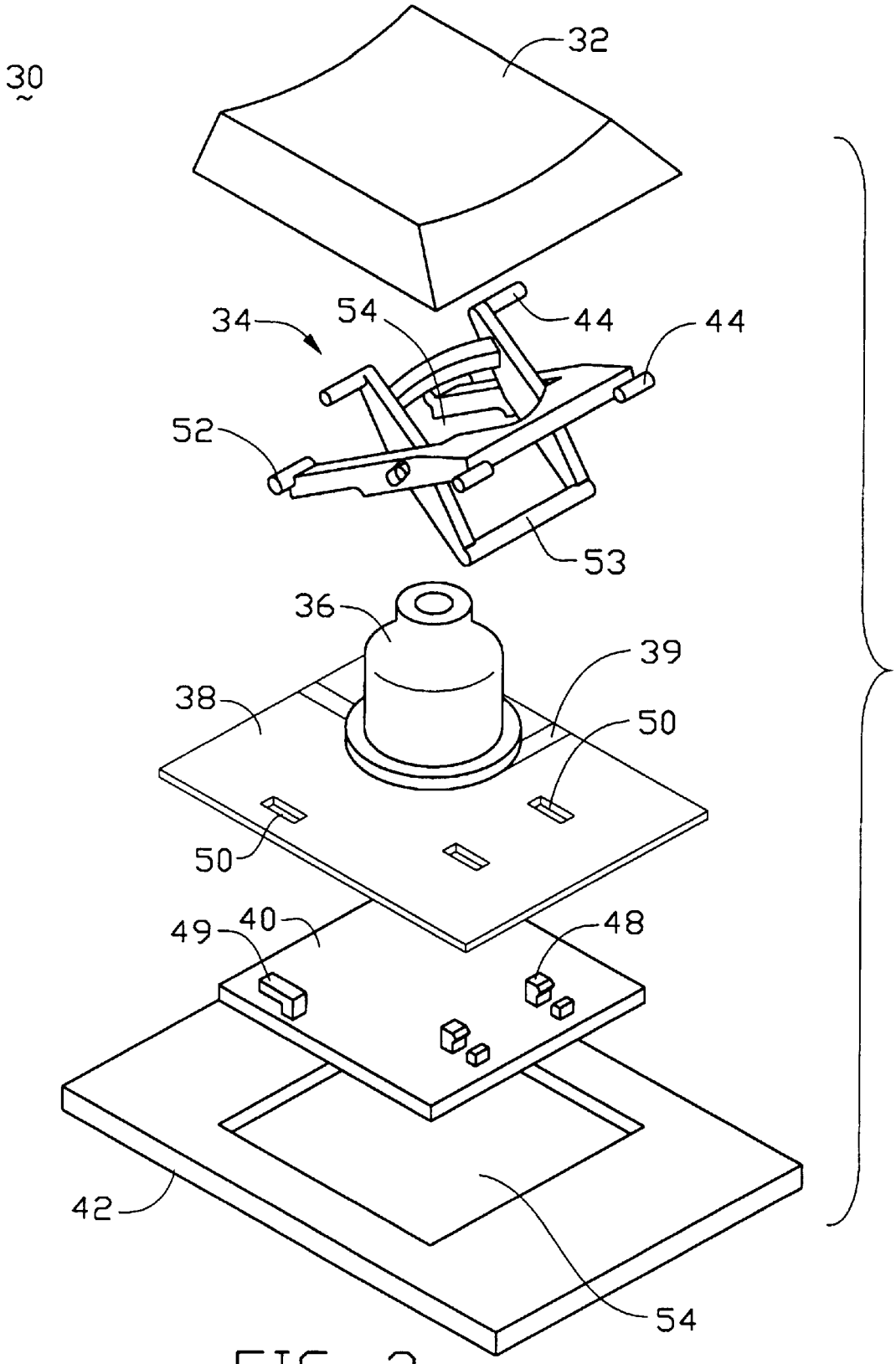
FIG. 2 is an exploded view of a keyswitch assembly in accordance with a first embodiment of the present invention.

Referring to FIG. 2, a keyswitch assembly 30 in accordance with a first embodiment of the present invention consists of a cap 32, a link 34 and a conductive rubber 36 each having a structure like the conventional cap 12, link 14 and conductive rubber 18, respectively, a circuit membrane 38 defining a number of through holes 50 (only three shown), a mounting block 40 formed by plastic injection molding to have a pair of brackets 48 having a structure like the conventional brackets 24 and a pair of L-shaped protrusions 49 (only one shown) opposite the brackets 24 and a base plate 42 formed by plastic injection molding to define a number of recesses 54 (only one shown) therein each having a configuration mating the mounting block 40 and a size slightly smaller than it. A circuit 39 is formed on the circuit membrane 38.

To assemble the keyswitch assembly 30, all of the mounting blocks 40 constituting a computer keyboard are successively fitted into the recesses 54 of the base plate 42 to interferentially engage therewith wherein a top face of the mounting blocks 40 is flush with a top face of the base plate 42. Then, the circuit membrane 38 is put onto the base plate 42 and the mounting blocks 40 to reach a position wherein the brackets 48 and L-shaped protrusions 49 extend through the corresponding holes 50 in the circuit membrane 38. The conductive rubber 36 is positioned on the circuit membrane 38 and located above a corresponding switch (not shown) of the circuit 39. The link 34 is thereafter mounted to a corresponding mounting block 40 by engaging a left foot 52 thereof with the L-shaped protrusions 49 and a right foot 53 thereof with the brackets 48 in which an upper portion of the sleeve 36 extends through a middle portion 54 of the link 34. Finally, the cap 32 is mounted to the link 34 by engaging upper studs 44 of the link 34 with a clamping jaw structure (not shown) in the cap 32. By such design, if one of the brackets 48 or the protrusions 49 is damaged or improperly formed, only the corresponding mounting block 40 is needed to be discarded and replaced with a new one; furthermore, the present invention does not need a large mold for forming all of the mounting units (inclusive of the brackets 48 and L-shaped protrusions 49) on a single plate; thus, the mold cost can be lowered. In conclusion, a computer keyboard constructed by the keyswitch assembly 30 in accordance with the present invention can have a lower cost in comparison with the conventional one.

Figure 3:
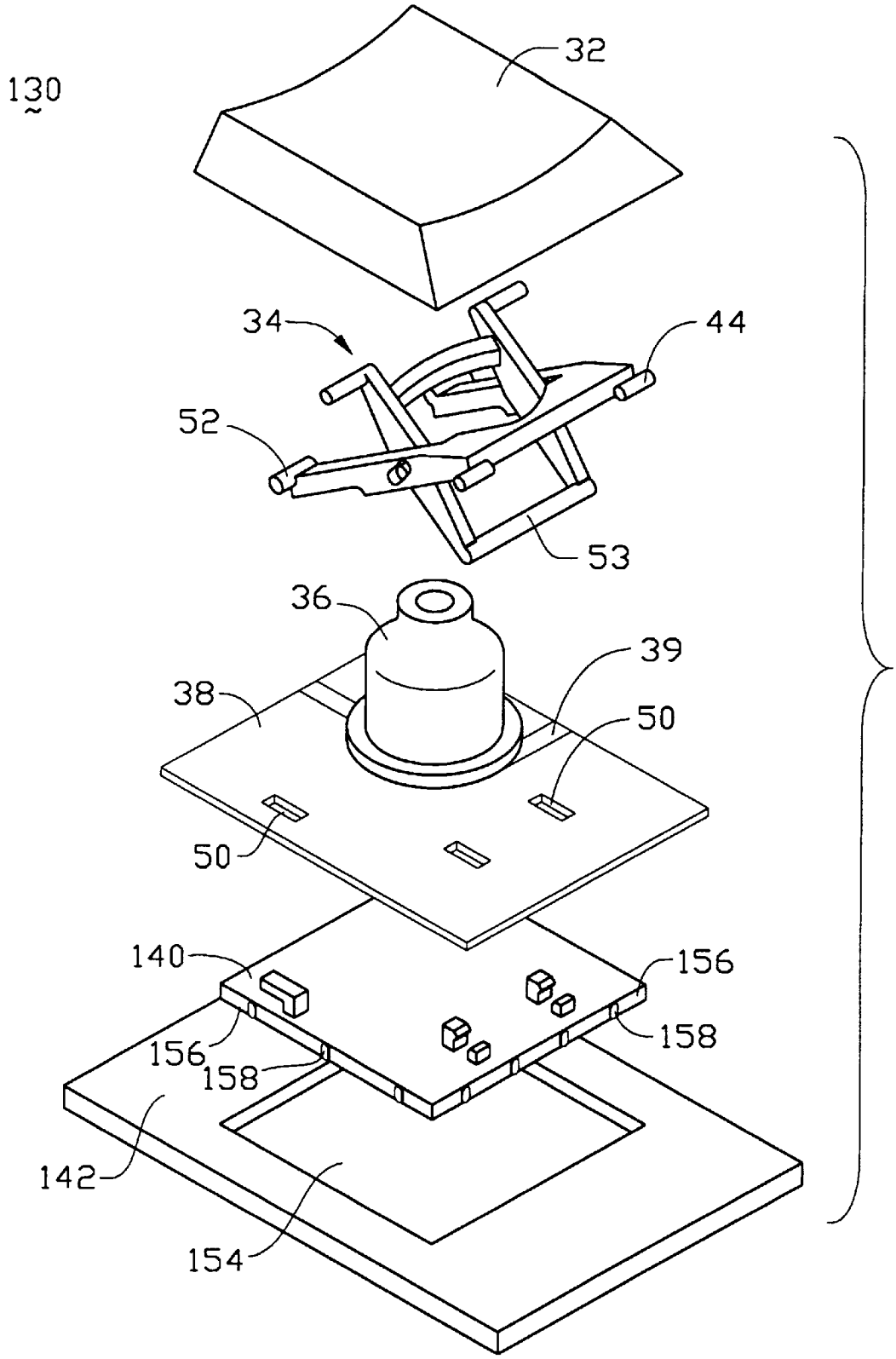
FIG. 3 is an exploded view of the keyswitch assembly in accordance with a second embodiment of the present invention.

FIG. 3 shows a keyswitch assembly 130 in accordance with a second embodiment of the present invention. The second embodiment is similar to the first embodiment except that a periphery 156 of the mounting block 140 is formed with a number of teeth 158 thereon for increasing the engaging force between the mounting block 140 and the base plate 142 when the mounting block 140 is fitted into the recess 154.

Figure 4:
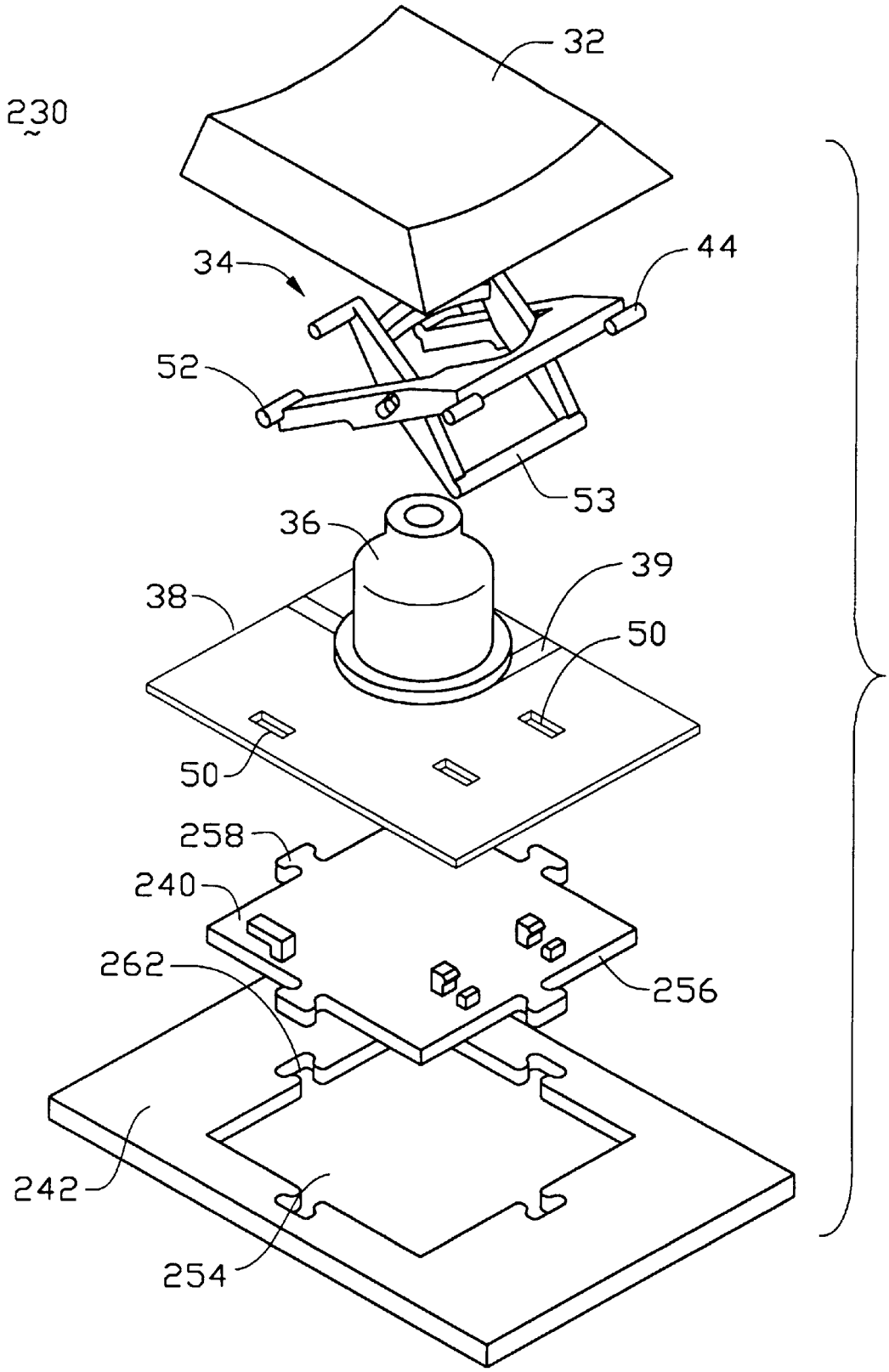
FIG. 4 is an exploded view of the keyswitch assembly in accordance with a third embodiment of the present invention.

FIG. 4 shows a keyswitch assembly 230 in accordance with a third embodiment of the present invention. The third embodiment is similar to the first embodiment except that a periphery 256 of the mounting block 240 is formed with four ears 258 projecting therefrom outwards. The ears 258 are fitted into four corresponding depressions 262 beside the recess 254 when the mounting block 240 is fitted into the recess 254 of the base plate 242.

Figure 5:
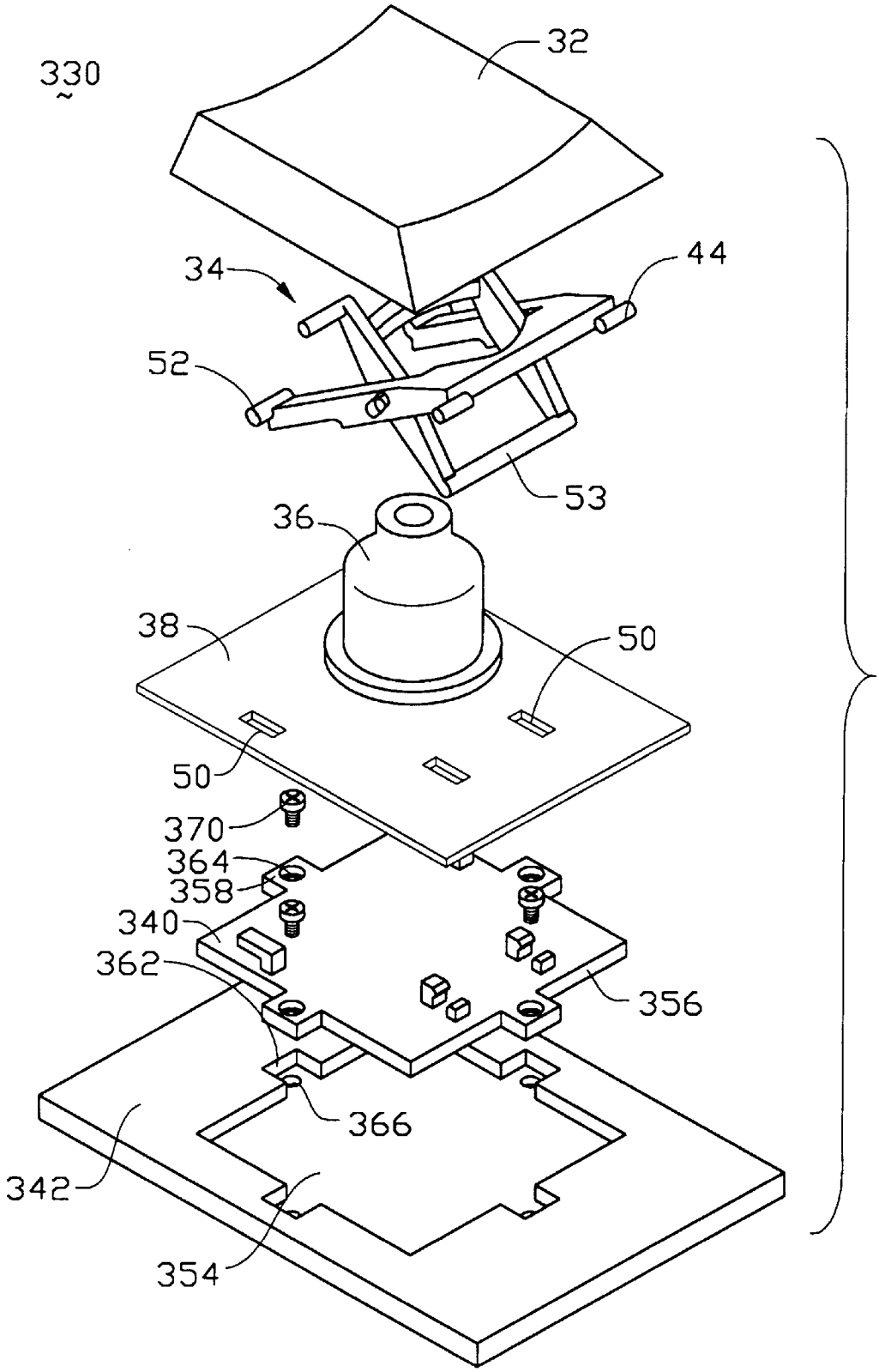
FIG. 5 is an exploded view of the keyswitch assembly in accordance with a fourth embodiment of the present invention.

FIG. 5 shows a keyswitch assembly 330 in accordance with a fourth embodiment of the present invention. The fourth embodiment is similar to the first embodiment except that a periphery 356 of the mounting block 340 is formed with four rectangular ears 358 projecting outwards therefrom; each ear 358 defines a hole 364 therethrough. The base plate 342 is formed with four corresponding depressions 362 beside the recess 354 and four threaded holes 366 in the four depressions 362, respectively. After the mounting block 340 is fitted into the recess 354, four screws 370 are extended through the holes 364 to threadedly engage with the threaded holes 366 in the depressions 362, respectively, thereby fixedly connecting the mounting block 340 and the base plate 342 together.

Figure 6:
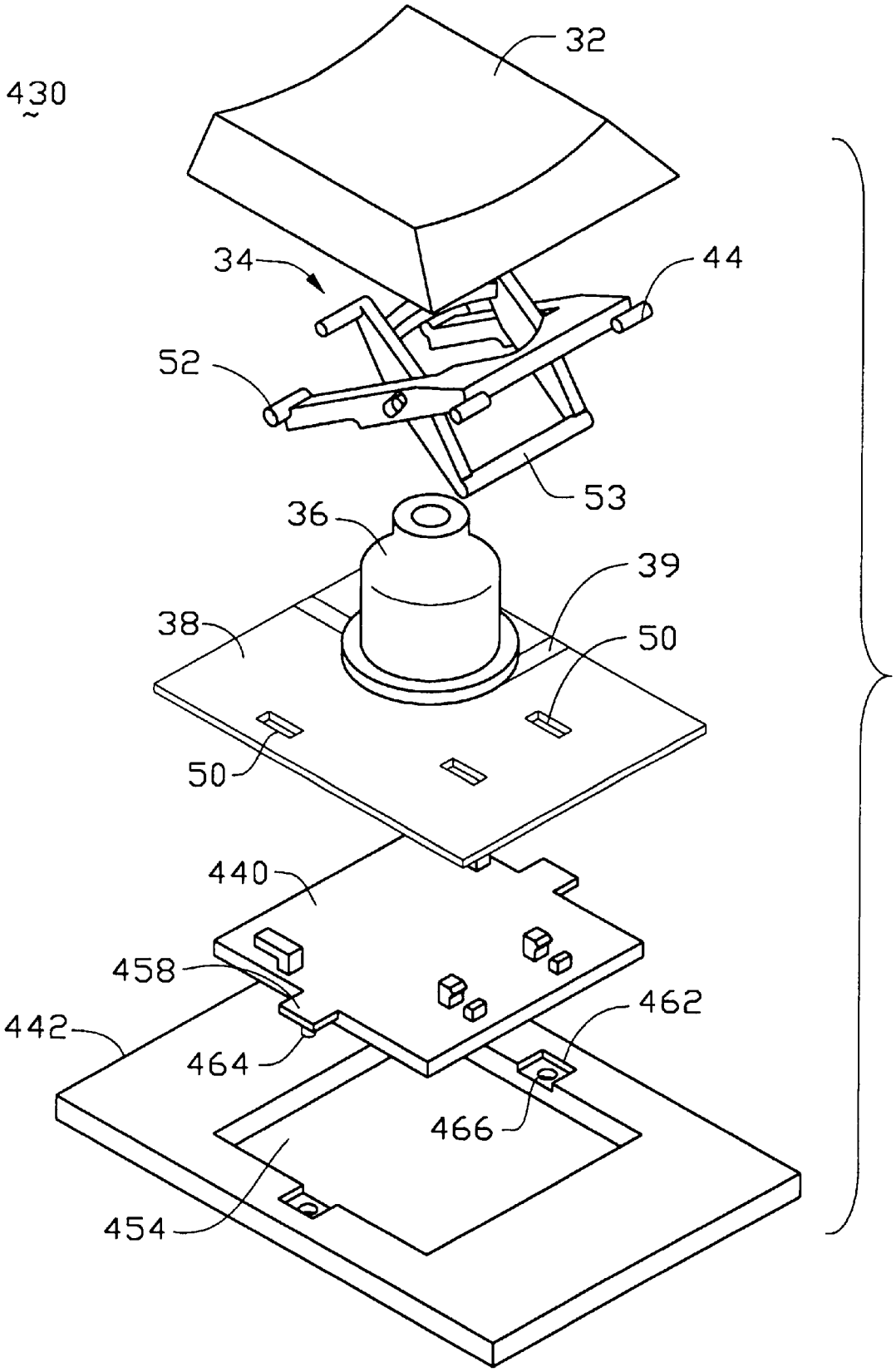
FIG. 6 is an exploded view of the keyswitch assembly in accordance with a fifth embodiment of the present invention.

FIG. 6 shows a keyswitch assembly 430 in accordance with a fifth embodiment of the present invention. The fifth embodiment is similar to the first embodiment except that a periphery of the mounting block 440 is formed with two opposite rectangular ears 458 projecting outwards therefrom and two shafts 464 below the two ears 458, respectively. The base plate 442 defines a number of rectangular openings 454 (only one shown) and two opposite depressions 462 beside each opening 454 and two holes 466 in the two depressions 462, respectively. The holes 466 extend through the base plate 442. When the mounting block 440 is fitted into the opening 454, the two ears 458 are fitted into the two corresponding depressions 462 and the two shafts 464 are extended through the two corresponding holes 466. Thereafter, a heat melting operation is applied to a free end of each of the shafts 464 to fixedly connect the shafts 464 (accordingly, the mounting block 440) and the base plate 442 together.

Figure 7:
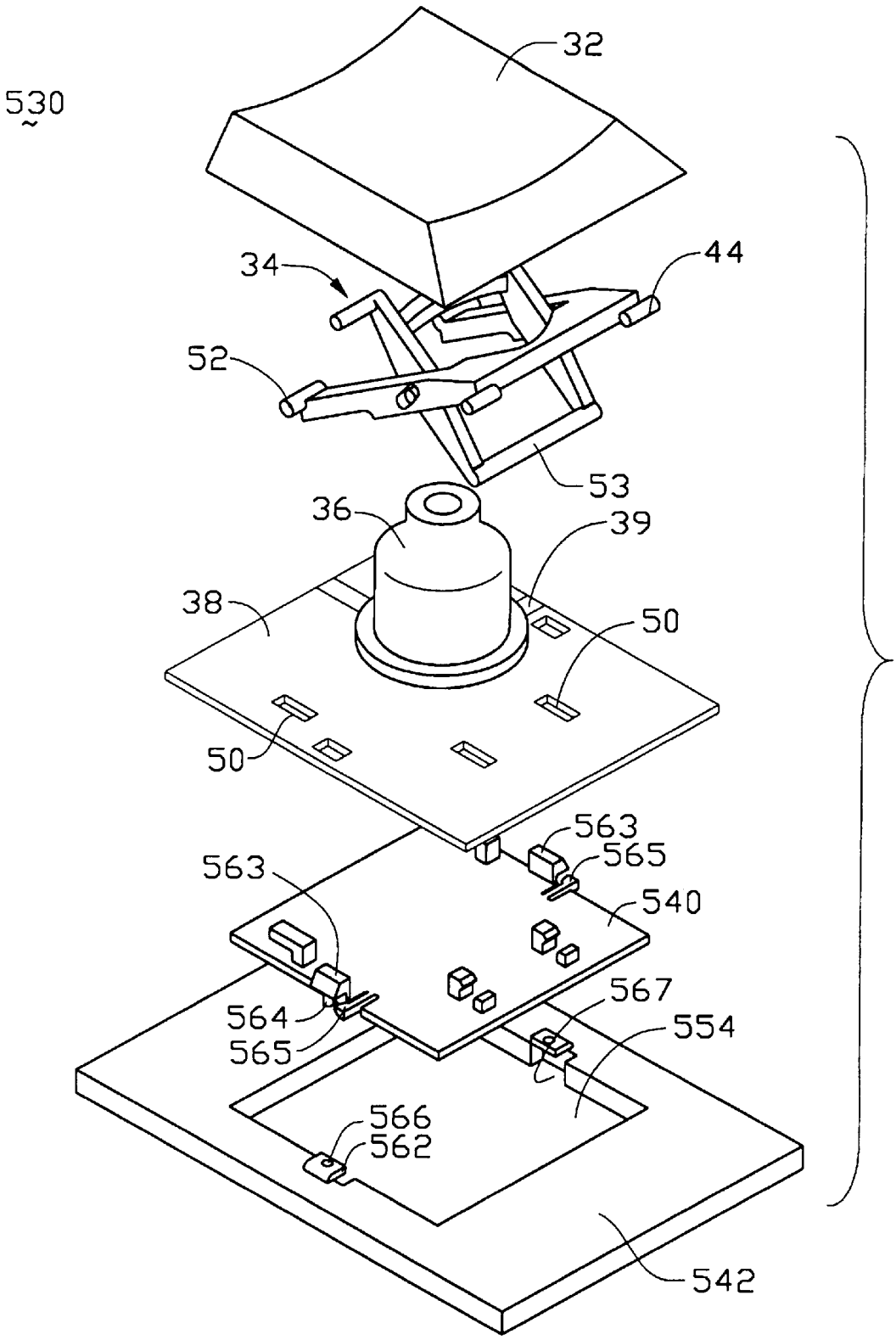
FIG. 7 is an exploded view of the keyswitch assembly in accordance with a sixth embodiment of the present invention.
Figure 8:
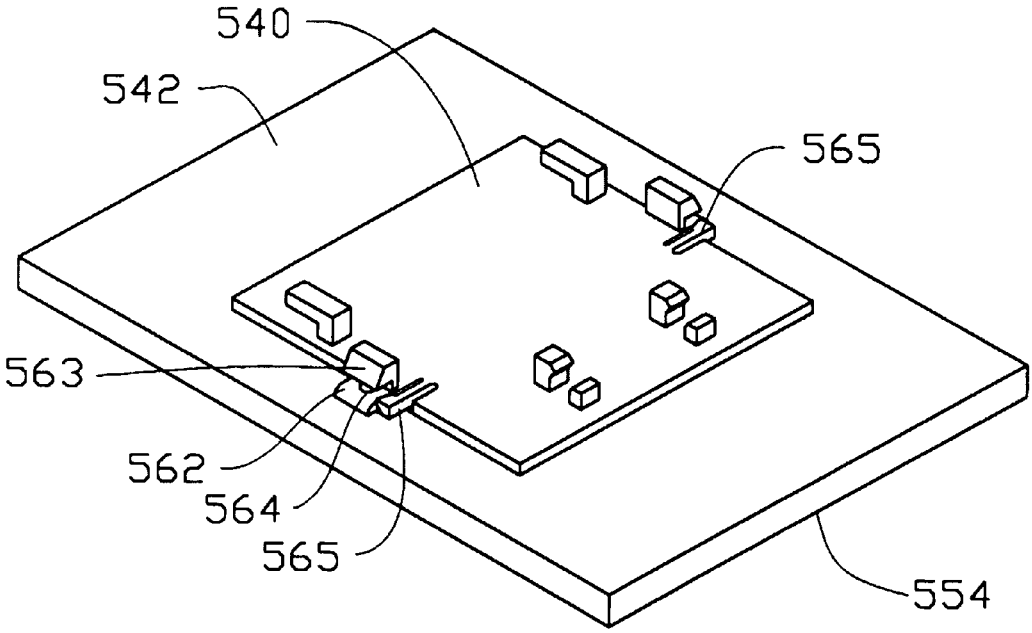
FIG. 8 is a perspective view of the sixth embodiment showing a mounting block to be assembled with a base plate thereof.
Figure 9:
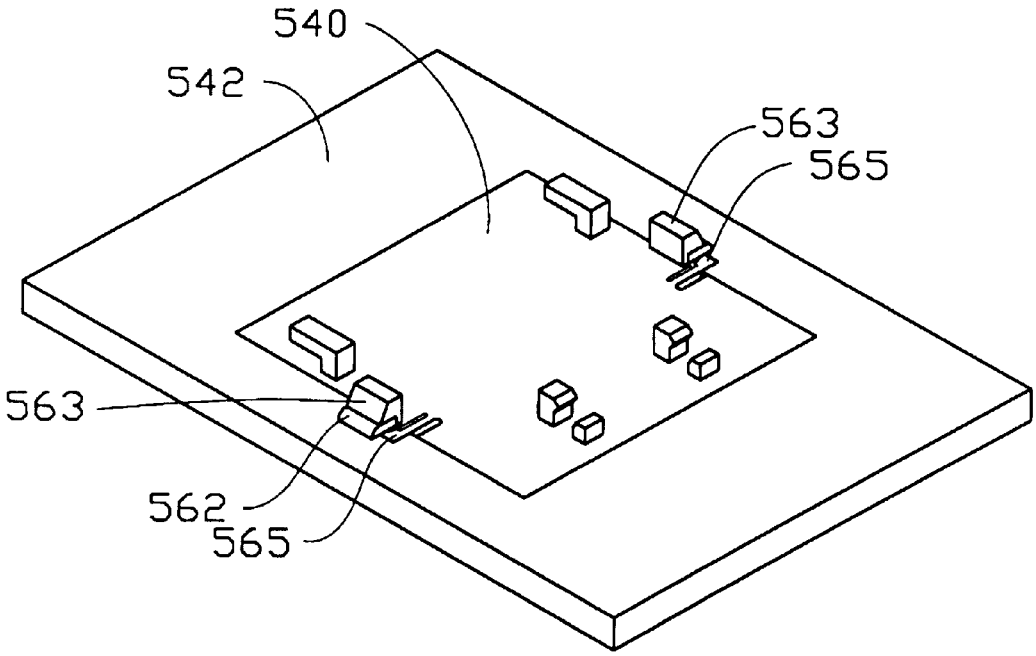
FIG. 9 is a perspective view of the sixth embodiment showing the mounting block assembled with the base plate.

FIGS. 7–9 show a keyswitch assembly 530 in accordance with a sixth embodiment of the present invention. The sixth embodiment is similar to the first embodiment except that a periphery of the mounting block 540 is formed with two opposite ears 563 projecting outwards therefrom. Each ear 563 is integrally formed with a shaft 564 extending therebelow. Two resilient arms 565 are formed beside the two shafts 564, respectively. The base plate 542 defines a number of rectangular openings 554 (only one shown) and is formed with two opposite tongues 562 beside each opening 554 and above two depressions 567 beside the opening 554. Each tongue 562 defines a hole 566 therethrough. When the mounting block 540 is fitted into the opening 554, the two shafts 564 are extended through the two holes 566 while the resilient arms 565 are fitted into a portion of each of the two depressions 567 beside the corresponding tongue 562 and the two ears 563 overlie the tongues 562 (best seen in FIGS. 8 and 9). Thereafter, a heat melting operation is applied to a free end of each of the shafts 564 to fixedly connect the tongues 562 and the ears 563, and, accordingly, the base plate 542 and the mounting block 540 together.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A keyswitch assembly for constructing a computer keyboard, comprising:

a cap adapted to receive a key-in force of a user of the computer keyboard;

a link having an upper portion clippingly connected with the cap and a lower portion;

a conductive rubber having an upper portion extending through the link to engage with the cap and a lower portion;

a circuit membrane contacting with the lower portion of the conductive rubber;

a mounting block having a mounting means extending through the circuit membrane for supportively engaging with the lower portion of the link; and a base plate defining a number of recesses, one of which fittingly receives the mounting block;

wherein the mounting block is formed by plastic injection molding, the recess and the mounting block are formed in a rectangular configuration corresponding to each other, and the recess and the mounting block are formed with the recess having a size slightly smaller than the size of the mounting block.

2. The assembly in accordance with claim 1, wherein a periphery of the mounting block is formed with a plurality of teeth to increase the engaging force between the mounting block and the base plate.

3. The assembly in accordance with claim 1, wherein the mounting block is formed with four ears extending outwards from four sides thereof, and the base plate further defines four depressions beside the recess, each depression having a configuration corresponding to the ear, the mounting block being fitted into the recess and the ears being fitted into the depressions.

4. The assembly in accordance with claim 3, further comprising four screws extending through the four ears of the mounting block to threadedly engage with the base plate.

5. The assembly in accordance with claim 1, wherein a top face of the base plate is flush with a top face of the mounting block.

6. The assembly in accordance with claim 5, wherein the mounting means comprises at least an L-shaped protrusion on the top face of the mounting block.

* * * * *